United States Patent [19]

Jensen et al.

[11] Patent Number: 4,739,598

[45] Date of Patent: Apr. 26, 1988

[54] MUDSILL ANCHOR

[75] Inventors: Mark B. Jensen, Bothell, Wash.; Douglas T. Silver, Danville, Calif.

[73] Assignee: Silver Silver Metal Products, Inc., Livermore, Calif.

[21] Appl. No.: 11,901

[22] Filed: Feb. 6, 1987

Related U.S. Application Data

[63] Continuation-in-part of Ser. No. 900,416, Aug. 26, 1986, abandoned.

[51] Int. Cl.[4] ..... E02D 27/00

[52] U.S. Cl. ..... 52/295; 52/712; 52/714

[58] Field of Search ..... 52/712, 714, 715, 295, 52/370

[56] References Cited

U.S. PATENT DOCUMENTS

| | | | |
|---|---|---|---|
| 1,909,984 | 5/1933 | Prindle | 52/370 |
| 3,889,440 | 6/1975 | Sutter | 52/370 |
| 3,889,441 | 6/1975 | Fortine | 52/370 X |
| 4,404,781 | 9/1983 | Gilb | 52/295 |
| 4,413,456 | 11/1983 | Gilb | 52/295 |
| 4,422,279 | 12/1983 | Powell | 52/370 X |

*Primary Examiner*—Carl D. Friedman

*Attorney, Agent, or Firm*—Robert R. Tipton

[57] ABSTRACT

An improved mudsill anchor is provided with tabs is its attachment arm or arms for fastening the anchor temporarily to a form board without nails to achieve significant savings in labor and improvement in lateral stability of the anchor during installation of a concrete slab foundation. Further improvements include a bendable tab formed from the lower end of the anchor leg for tying the leg to a reinforcing bar and a bent tab proximate the upper end of the leg that is embedded into the form board to prevent the reinforcing bar from pulling the mudsill anchor up from the form board.

16 Claims, 8 Drawing Sheets

10B
10B
10
16
18
20
21
38
64
69
70
72
80
90
92
102
104
120
122
124
126
130
140

MUDSILL ANCHOR

CROSS REFERENCE TO RELATED APPLICATION

This application is a continuation-in-part of application Ser. No. 06/900,416, filed Aug. 26, 1986, now abandoned.

BACKGROUND OF THE PRIOR ART

This invention relates generally to anchors embedded in concrete and in particular to mudsill anchors.

The mudsill anchors of the prior art included a variety of configurations from simple bolts embedded in the concrete slab which were adapted to be received in a hole in the mudsill and be held in place by a nut and washer combination to complex configurations of strap metal and fasteners.

One anchor included a pair of metal straps attached at their lower end and embedded at an angle in the concrete. The upper end of each strap was designed to be fastened to each vertical side of the mudsill and bent over the top of the mudsill for nailing on the top horizontal surface of the mudsill.

Another mudsill anchor included a pair of attachment arms attached to an anchor leg that depended downwardly into the concrete slab at an angle. The anchor leg was temporarily nailed to the form board defining the periphery of the slab during construction.

It was necessary to rigidly fasten the mudsill anchor to the form board during construction to prevent its dislodgement during installation.

Dislodgement during construction could be caused during a number of steps in construction included the attachment of reinforcing rods to the mudsill anchor leg, pouring of concrete around the anchor leg, using vibrators in the concrete during pouring, screeding the concrete during and after pouring using the form board as a guide and final finishing of the surface of the concrete using mechanical trowels.

Unless the mudsill anchor of the prior art was firmly nailed to the form board, necessitating a significant expenditure in labor and time, the anchor could be loosened during pouring of the concrete and then would have a tendency to twist or turn relative to the form board if it happened to be struck by a mechanical trowel during finishing of the concrete slab surface.

In addition, any mudsill anchors that were installed in error and had to be relocated were sometimes damaged and made unusable if the fastening nail had to be removed, usually by a claw hammer.

Summary of the Invention

The mudsill anchor of the present invention is a significant improvement over the prior art devices in that a new and useful method of temporary attachment to the form board is used in which means are incorporated in the attachment arm for frictionally engaging both sides of the form board with sufficient force to hold the mudsill anchor in place during construction.

In addition, the improved mudsill anchor combines attachment tabs with a nailable tab or gripper prongs and a reinforcing bar tab to substantially reduce installation time and labor.

This improvement comprises a pair of spaced apart first and second attachment arm tabs depending downwardly proximate the sides of the attachment arm. When the attachment arm is placed on the top edge of the form board, the end of each tab is adapted to grasp or frictionally engage the outside surface of the form board in cooperation with a gripper member or pressure plate proximate the point of connection of the anchor leg to the attachment arm, which gripper member or pressure plate is adapted to engage the inner surface of said form board to maintain the tabs in frictional engagement with the outer surface of the form board.

If the mudsill anchor utilizes a pair of spaced apart attachment arms, an attachment tab is provided in each arm.

It is, therefore, an object of the present invention to provide a new and improved mudsill anchor.

It is a further obJect of the present invention to provide a mudsill anchor that can be attached to a form board with a minimum of labor.

It is another object of the present invention to provide a mudsill anchor in which a pair of spaced apart attachment tabs are located in the attachment arm and are adapted to frictionally engage the outer surface of a form board in cooperation with a gripper or compression member frictionally engaging the inner surface of the form board.

It is yet a further object of the present invention to provide a mudsill anchor in which there is further provided tabs, proximate the end of the anchor leg imbedded in the concrete slab, for attaching a reinforcing member to the anchor leg, the reinforcing bar being disposed parallel to the periphery of the concrete slab.

It is a further object of the present invention to provide a mudsill anchor in which uplift of the anchor is prevented using a tab deformed from the upper end of the anchor leg that is nailable into the inner surface of the form board.

These and other objects of the present invention will become manifest upon study of the following detailed description when taken together with the drawings.

DESCRIPTION OF THE PREFERRED EMBODIMENT

Figure 1:
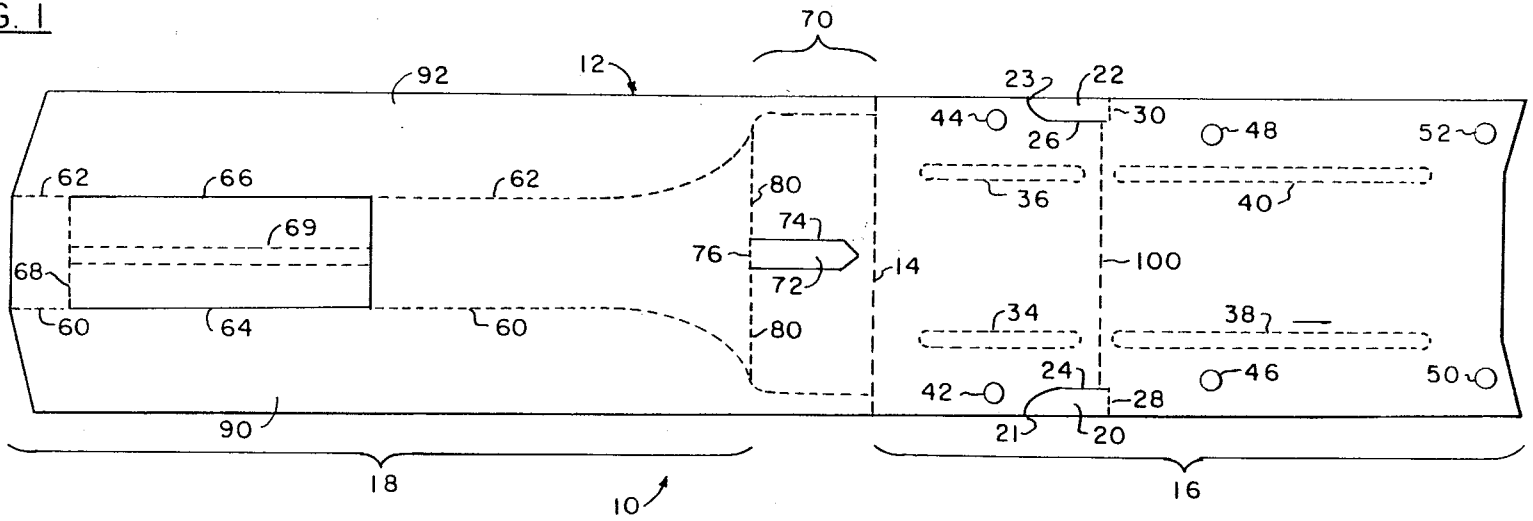
FIG. 1 is a plan view of the mudsill anchor of the present invention starting with the sheet metal blank from which the anchor is made and showing the location of bend lines and shear lines prior to deforming the blank into the completed anchor.

With reference to FIG. 1, mudsill anchor 10 of the present invention is manufactured from a single mudsill anchor of sheet metal blank 12 with the shear lines shown solid and the bend line shown dashed.

Initially, sheet metal blank 12 is bent at a 90 degree angle along anchor leg-attachment arm bend line 14, proximate the mid-point of sheet 12, to thus define an anchor attachment arm 16 and an anchor leg 18 which are the basic elements of the anchor.

Attachment arm 16 comprises a pair of tabs 20 and 22 defined by shear lines 24 and 26, respectively, and bend lines 28 and 30, respectively, proximate the outer edge on each side of attachment arm 16.

Attachment arm 16 is further provided with a set of stiffening deformations 34, 36, 38 and 40 to limit bending to anchor leg-attachment arm bend line 14 and mudsill side bend line 100 shown during field installation of the anchor.

Figures 3, 10A, 10B:
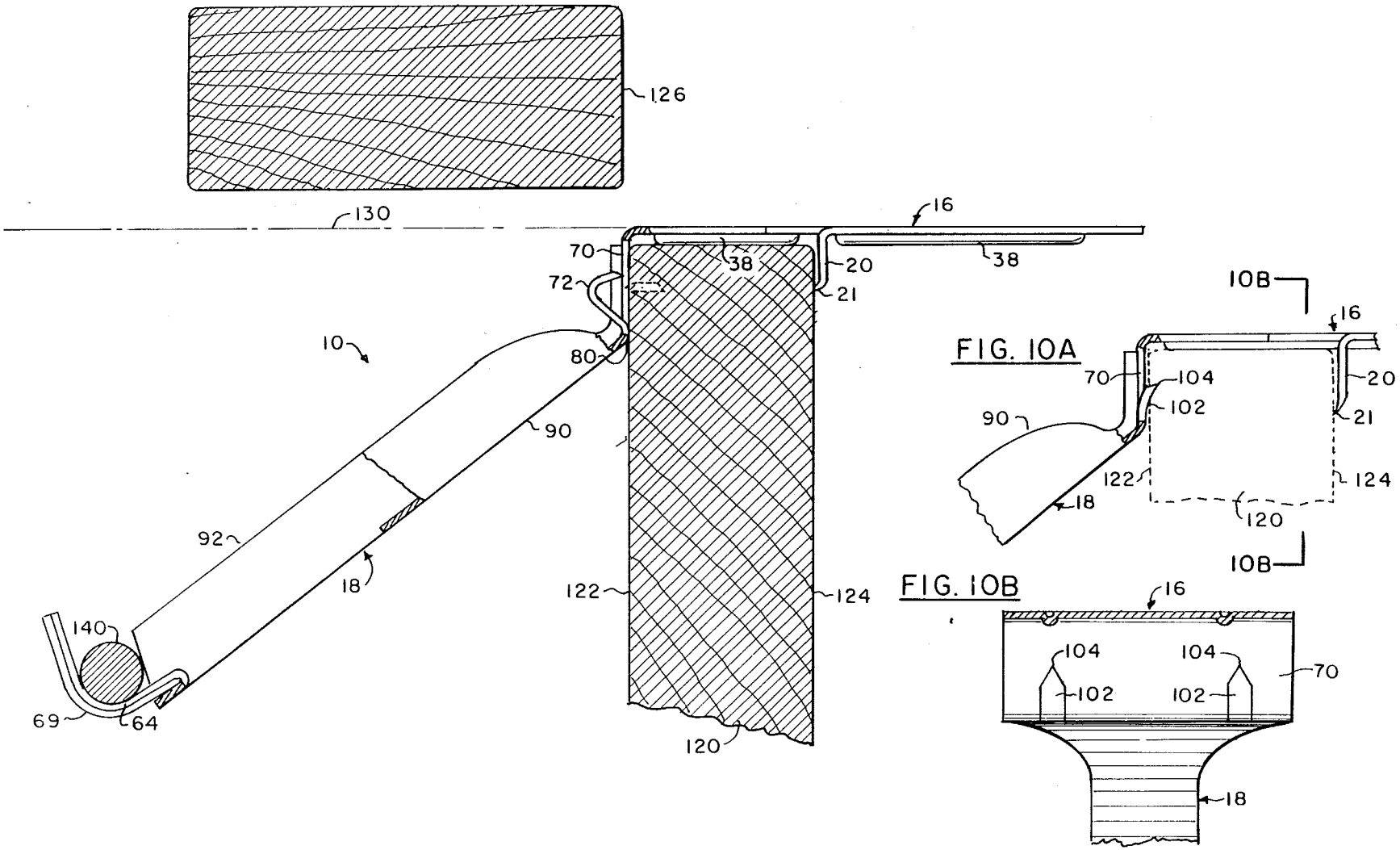
FIG. 3 is a side elevational view of the completed mudsill anchor of the present invention shown attached to a typical form board prior to pouring of concrete.
FIG. 10A is a side elevational view of the mudsill anchor of the present invention showing a detail of the gripper members used to prevent the anchor from being removed from the form board.
FIG. 10B is a front elevation view of the mudsill anchor of FIG. 10A.

Nail holes 42, 44, 46, 48, 50 and 52 are also provided in attachment arm 16 which are adapted to receive the nails used to attach attachment arm 16 to the mudsill (See FIG. 3).

Anchor leg 18 comprises side member 90 and 92 bend lines 60 and 62, respectively, and reinforcing bar support and attachment tab 64 defined by shear line 66 and bend line 68. Stiffener deformation 69 is also provided in tab 64.

The upper end of anchor leg 18 further comprises a form board nailable tab 72 defined by shear line 74 and bend line 76 (coincident with bend line 80).

A further anchor leg-gripper member bend line 80 (a portion of which is coincident with bend line 76) is provided to define gripper member or pressure plate 70 proximate the upper end of anchor leg 18 between attachment arm-anchor leg bend line 14 and bend line 80.

At bend line 80, anchor leg 18 is bend at an obtuse angle to gripper member or pressure plate 70 so that it projects downwardly at an angle into the concrete slab when attached to the form board.

Figure 2:
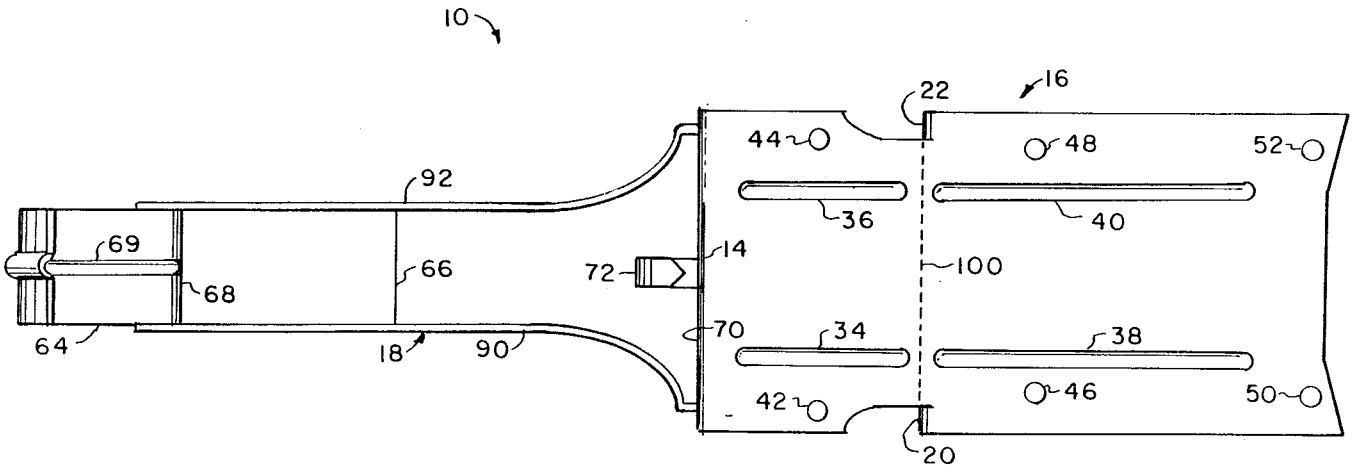
FIG. 2 is a top view of the completed mudsill anchor sheared and bent according to the shear and bend lines of FIG. 1.

With reference to FIG. 2, there is illustrated a top view of the completed mudsill anchor of the present invention in which the sides of leg 18 have been bent along bend lines 60 and 62 to define side members 90 and 92, respectively.

Attachment arm tabs 20 and 26 have been bent to project downwardly at right angle to the plane of attachment arm 16.

Form board nailable tab 72 is shown in its deformed position ready to be driven into the form board.

It will be noted in FIGS. 1 and 2 that a further bend line 100 is shown in attachment arm 16 between stiffener members 34, 34 and 38, 40.

The location of mudsill side bend line 100 will depend upon the thickness of the mudsill being installed on the completed concrete slab. In FIG. 2, bend line 100 happens to be located proximate the inner surface of tabs 20 and 26.

With reference to FIG. 3 there is illustrated a side elevational view of mudsill anchor 10 of the present invention shown attached to a typical form board 120 having an inner face or side 122 and an outer face or side 124.

Mudsill anchor 10 is shown prior to pouring of concrete along the inner face or side 122 of form board 120. The finished surface of the concrete slab is indicated by dashed phantom line 130.

In FIG. 3 gripper member or pressure plate 70 is shown bearing against the inner side 122 of form board 120 with tip 21 of tab 20 shown curved inwardly toward the outer face 124 of form board 120 to frictionally engage form board outer surface 124 with the help of gripper member or pressure plate 70.

In a like manner, tip 23 of tab 22 (not seen in FIG. 3 since it is located behind tab 20) is adapted to also grip outer surface 124 of form board 120.

Thus gripper member or pressure plate 70, in cooperation with tabs 20 and 22, will hold the vertical centerline plane of mudsill anchor 10 perpendicular to the plane of form board 120 and prevent lateral twisting or turning of anchor 10 during installation of the concrete slab.

Figures 3A, 9:
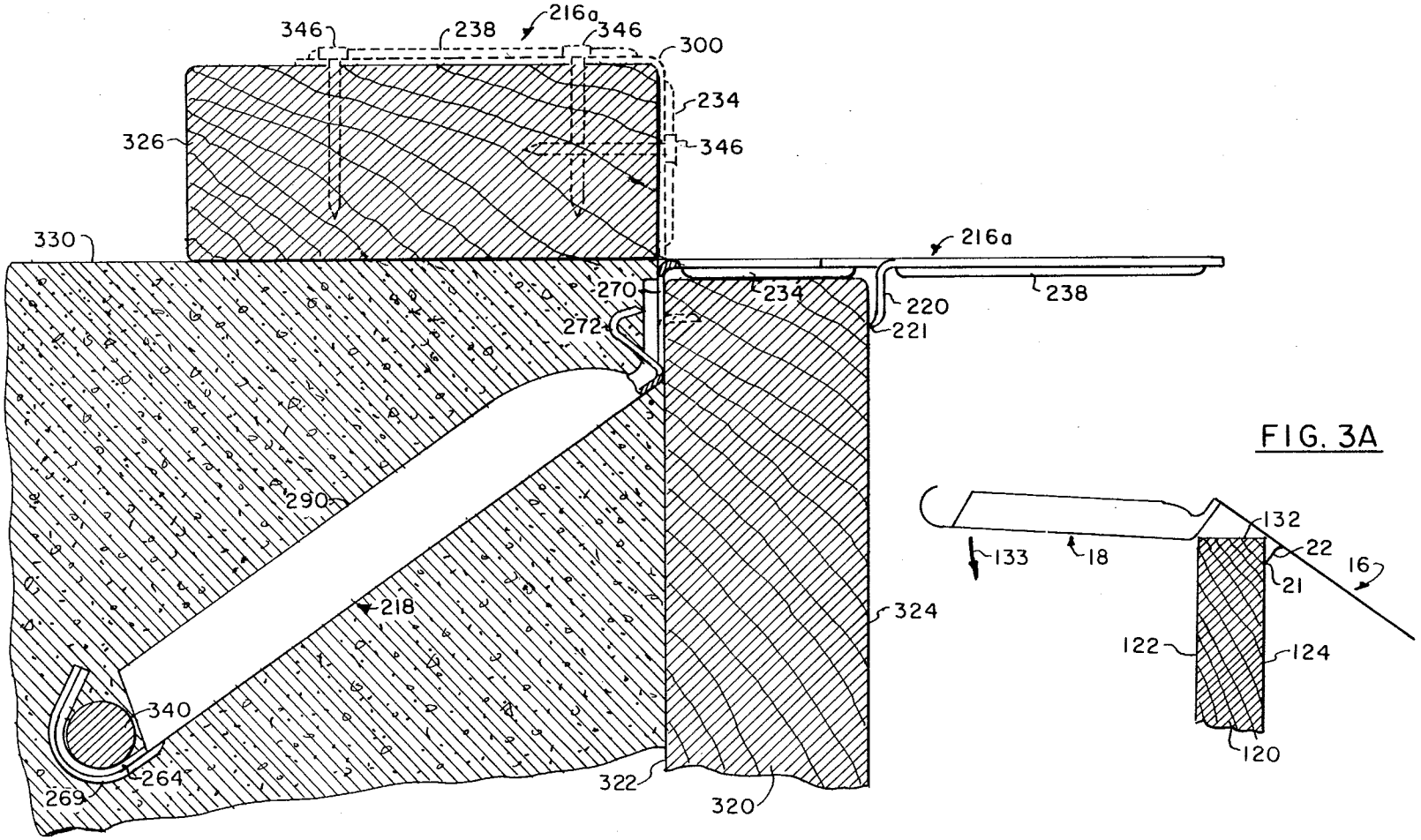
FIG. 3A is a reduced scale side elevational view of the mudsill anchor of FIG. 3 showing how the anchor is attached to the form board.
FIG. 9 is a side elevational view of the completed and installed mudsill anchor of the present invention shown attached to a typical form board after pouring of concrete.

To illustrate how the mudsill anchor 10 of the present invention is installed on form board 120, FIG. 3A is a reduced scale drawing of mudsill anchor 10 shown as it is initially placed on the top edge of form board 120.

In this position, the plane of attachment arm 16 is rotated or tilted so that the bottom surface of attachment arm 16 between tabs 20 and 22 and gripper member or pressure plate 70, rests on the corner of form board 120 defined by the intersection of its top edge 132 and outer face 124.

As attachment arm 16 is held in this position against the corner of form board 120, it is then moved to cause tip 21 of tab 20 and tip 23 of tab 22 to engage outer surface 124 of form board 120.

When tips 21 and 23 have engaged surface 124, leg 18 of mudsill anchor 10 is rotated downwardly, as indicated by arrow 133, causing gripper member or pressure plate 70 to initially bear against the the corner of form board 120 defined by the intersection of top edge 132 with inner surface 122.

As leg 18 of mudsill anchor 10 is further rotated downwardly to assume the position shown in FIG. 3, bearing or pressure plate 70 will finally bear against inner face 122 of form board 120 to maintain pressure on tab tips 21 and 23 against outer surface 124 of form board 120 thus holding mudsill anchor 10 in place without the need of additional nails.

To prevent any uplift forces on anchor leg 18 from rotating anchor 10 in the opposite direction, nailable tab 72 can be driven into inner face 122 of form board 120 as shown by the dotted lines in FIG. 3.

Figure 4:
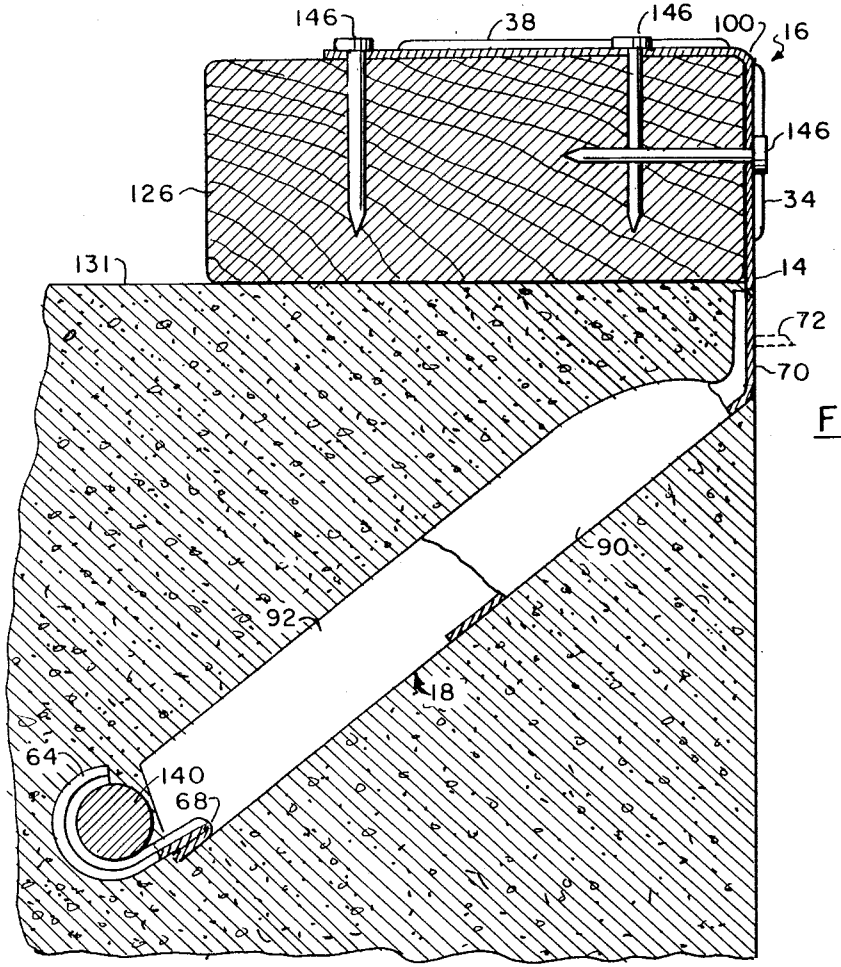
FIG. 4 a side elevational view of the mudsill anchor of the present invention after the concrete slab is poured and after the form board has been removed and the attachment arm attached to the mudsill.

With reference to FIG. 4, there is illustrated a elevational side view of mudsill anchor 10 of the present invention as installed in a concrete slab having a surface 131.

As shown in FIG. 4, reinforcing rod tab 64 has been bent around reinforcing bar 140, as by a blow from a hammer or the like, to attach it to leg 18.

Nailable tab 72 in pressure plate 70 has been deformed back into its original slot from its nailed position shown dotted.

In addition, attachment arm 16 has been bent upwardly to engage the outside edge of mudsill 126, and bent again at bend line 100 to wrap around mudsill 126 and cover a portion of the top of mudsill 126 where attachment arm 16 is attached to mudsill 126 by nails 146.

In addition, tabs 20 and 22, formerly engaging outer surface 124 of form board 120 have been deformed back into their original slots as by a hammer blow or the like to provide a smooth and neat installation securely holding mudsill 126 in place.

Figure 7:
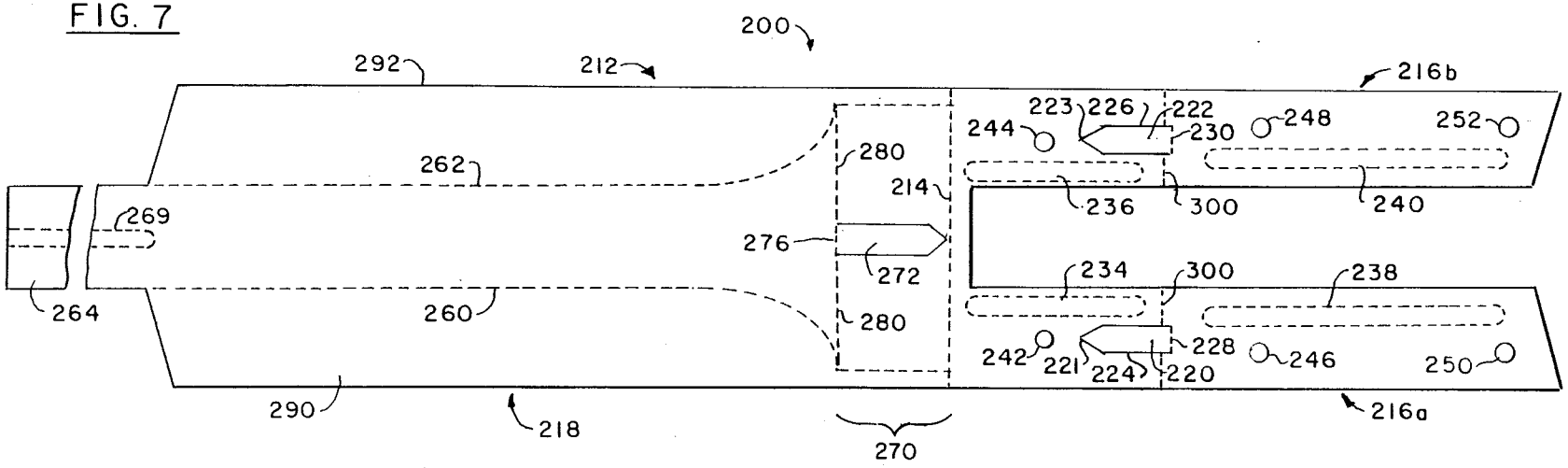
FIG. 7 is a plan view of a further embodiment of a mudsill anchor of the present invention having two attachment arms starting with the sheet metal blank from which the anchor is made and showing the location of the bend lines and shear lines prior to deforming the blank into the completed anchor.
Figure 8:
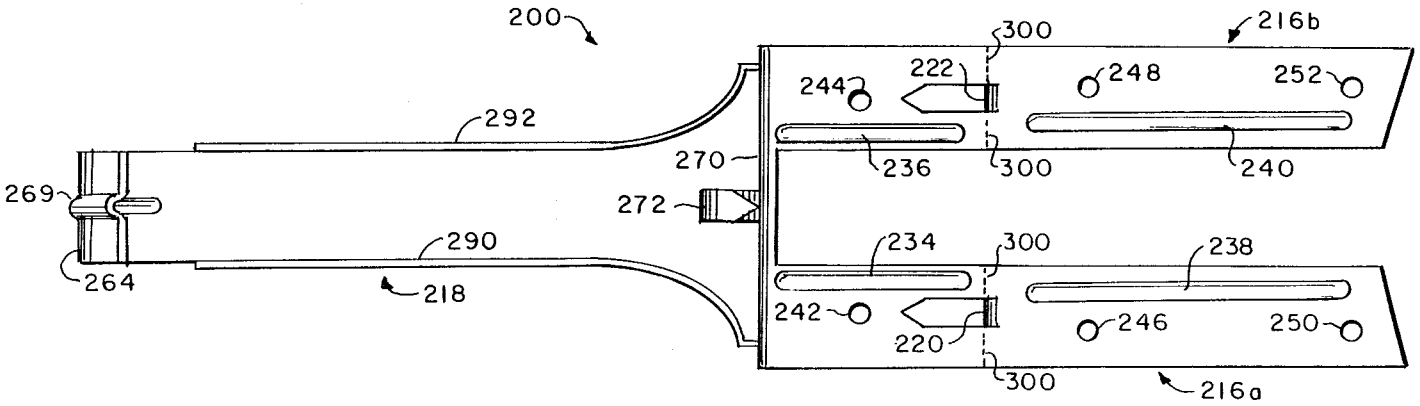
FIG. 8 is a top view of the completed mudsill anchor of FIG. 7 sheared and bent according to the shear and bend lines of FIG. 7.

With reference to FIGS. 7, 8 and 9, there is illustrated a further embodiment of the mudsill anchor of the present invention utilizing a pair of first and second generally parallel attachment arms 216*a* and 216*b*, respectively.

Mudsill anchor 200 of FIGS. 7–9 comprises basically the same elements as mudsill anchor 10 of FIGS. 1–6.

Like mudsill anchor 10, mudsill anchor 200 of the present invention is manufactured from a single mudsill anchor sheet metal blank 212 bent at a 90 degree angle along bend line 214, proximate the mid-point of sheet 212 to define a pair of generally parallel anchor attachment arms 216*a* and 216*b* and an anchor leg 218.

Attachment arms 216*a* and 216*b* each include a pair of tabs 220 and 222 defined by shear lines 224 and 226, respectively, and bend lines 228 and 230, respectively, proximate the middle of each attachment arm 216*a* and 216*b*.

Attachment arms 216*a* and 216*b* are further provided with a set of stiffening deformations 234, 238, 238 and 240.

Nail holes 242, 244, 246, 248, 250 and 252 are also provided in attachment arms 216*a* and 216*b* which are adapted to receive the nails used to attach attachment arms 216*a* and 216*b* to the mudsill (See FIGS. 9).

Anchor leg 218 comprises stiffener bend lines 260 and 262 and reinforcing bar support and attachment tab 264.

Reinforcing bar support and attachment tab 264 is obtained from the metal contained between the parallel attachment arms of the previous mudsill anchor sheet metal blank in the progressive manufacturing step.

Stiffener member 269 is also provided in tab 264 to support the weight of a reinforcing bar.

The upper end of anchor leg 218 further comprises a form board nailable tab 272 defined by shear line 274 and bend line 276 (coincident with bend line 280).

A further bend line 280 (a portion of which is also coincident with bend line 276) is provided to define a gripper member or pressure plate 270 proximate the upper end of anchor leg 218 between bend line 214 and bend line 280.

At bend line 280, anchor leg 218 is bend at an obtuse angle to gripper member or pressure plate 270 so that it projects downwardly at an angle into the concrete slab when attached to the form board.

With reference to FIG. 8, there is illustrated a top view of the completed mudsill anchor 200 of the present invention in which the sides of leg 218 have been bend along bend lines 260 and 262 to define side members 290 and 292, respectively.

Form board tabs 220 and 226 have been bent to project downwardly at right angles to the plane of attachment arms 216*a* and 216*b*.

Form board nailable tab 272 is shown in its deformed position ready to be driven into the form board.

It will be noted in FIGS. 7 and 8 that a further bend line 300 is shown in attachment arms 216*a* and 216*b* between stiffener members 238 and 240 and bend line 214.

The location of bend line 300 will depend upon the thickness of the mudsill being installed on the completed concrete slab. In FIG. 8, bend line 300 happens to be located proximate the inner surface of tabs 220 and 226.

With reference to FIG. 9 there is illustrated a side elevational view of mudsill anchor 10 of the present invention shown attached to a typical form board 320 having an inner face or side 322 and an outer face or side 324.

Mudsill anchor 200 is shown after pouring of concrete along the inner face or side 322 of form board 320. The finished surface of the concrete slab is indicated by line 330.

In FIG. 9, gripper member pressure plate 270 is shown bearing against the inner side 322 of form board 320 while tip 221 of tab 220 is shown curved inwardly toward outer face 324 of form board 320 to frictionally engage surface 324 with the help of pressure plate 270.

In a like manner, tip 223 of tab 222 (not shown in FIG. 9 since it is located behind tab 220) is adapted to grip the outer surface 324 of form board 320.

Thus gripper member or pressure plate 270, in cooperation with tabs 220 and 222, will hold the vertical center line plane of mudsill anchor 200 perpendicular to the plane of form board 320 and prevent lateral twisting or turning of anchor 200 during installation of the concrete slab.

Dashed lines show the position of nailable tab 272 when imbedded in form board 320 to prevent uplift forces from lifting mudsill anchor 200 up from form board 320.

Still with reference to FIG. 9, reinforcing rod tab 264 has been bent around reinforcing bar 340, as by a blow from a hammer or the like, to attach it to leg 218.

Shown in dotted lines are attachment arms 216*a* and 216*b* which have been bent upwardly to engage the outside vertical side of mudsill 326, and bent again at bend line 300 to wrap around mudsill 326 and cover a portion of the top of mudsill 326 where attachment arms 216*a* and 216*b* are attached to mudsill 326 by nails 346.

With reference to FIGS. 10A and 10B, there is illustrated a further embodiment of anchor 10 in the vicinity of the gripper member or pressure plate 70.

In FIG. 10A, in lieu of nailable tab 72, one or more gripper prongs 102 are provided which project inwardly toward inner surface or face 122 of form board 120. Tip 104 of gripper prong 102 is adapted to point upwardly so that it will incise and frictionally engage inner face 122 of form board 120 (shown in dashed or phantom lines) and prevent any uplift forces on anchor leg 18 from causing anchor 10 to be lifted off of the top edge of form board 120.

Figure 11:
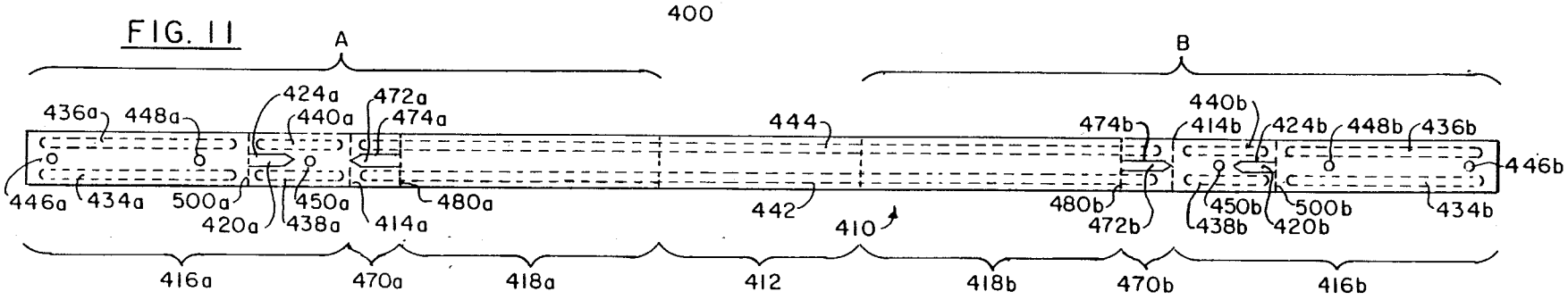
FIG. 11 is a plan view of a blank for a further embodiment of the mudsill anchor the the present invention fabricated from a strip of sheet metal showing the location of shear and bend lines prior to deformation of the metal strip into the complete anchor.

With reference to FIG. 11, there is illustrated a plan view of a blank 410 disclosing a further embodiment of the mudsill anchor 400 of the present invention fabricated from a strip of sheet metal showing the shear (solid) and bend or deformation (dashed) lines prior to deformation of the metal.

Mudsill anchor 400 of FIG. 11 comprises a blank strip 410 having a central bend section 412 whereby the blank is bent to bring the two straight end sections or legs "A" and "B" parallel to each other and wherein the two legs or straight sections "A" and "B" are twisted in opposite directions to bring the flat surface of each leg into a common plane.

Figure 12:
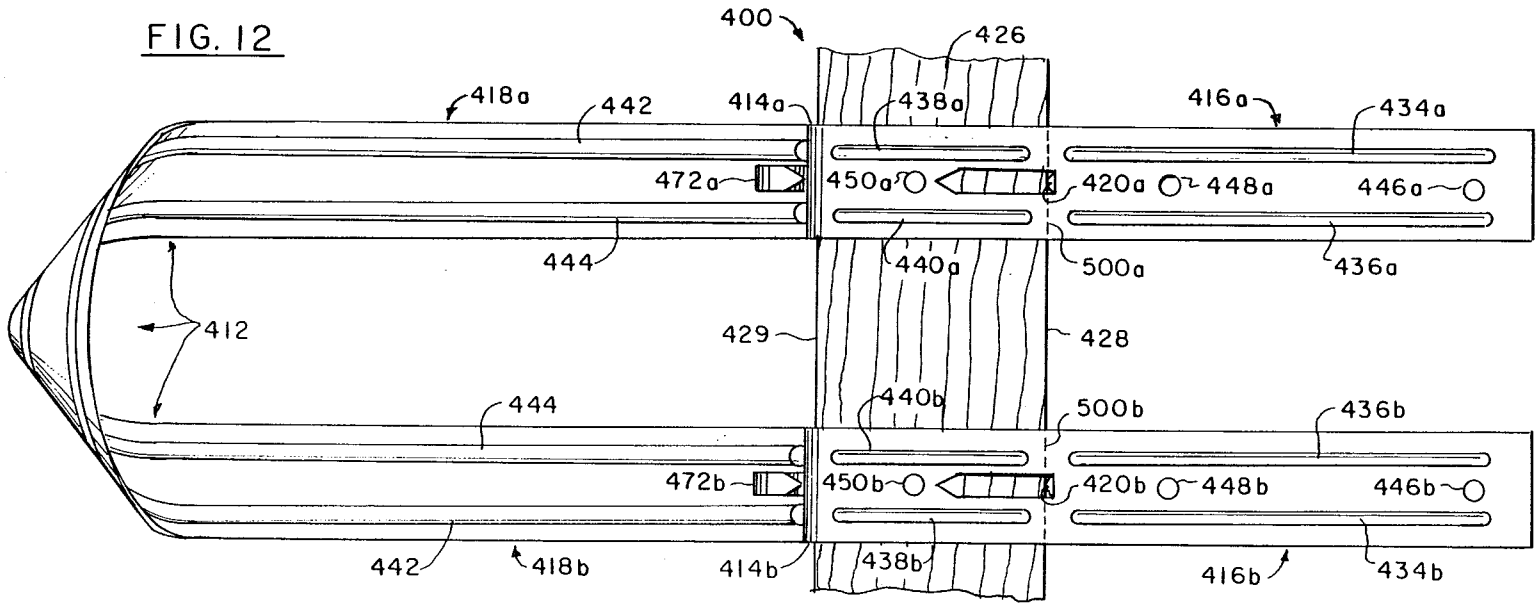
FIG. 12 is a top or plan view of the mudsill anchor fabricated from the blank shown in FIG. 11.
Figure 13:
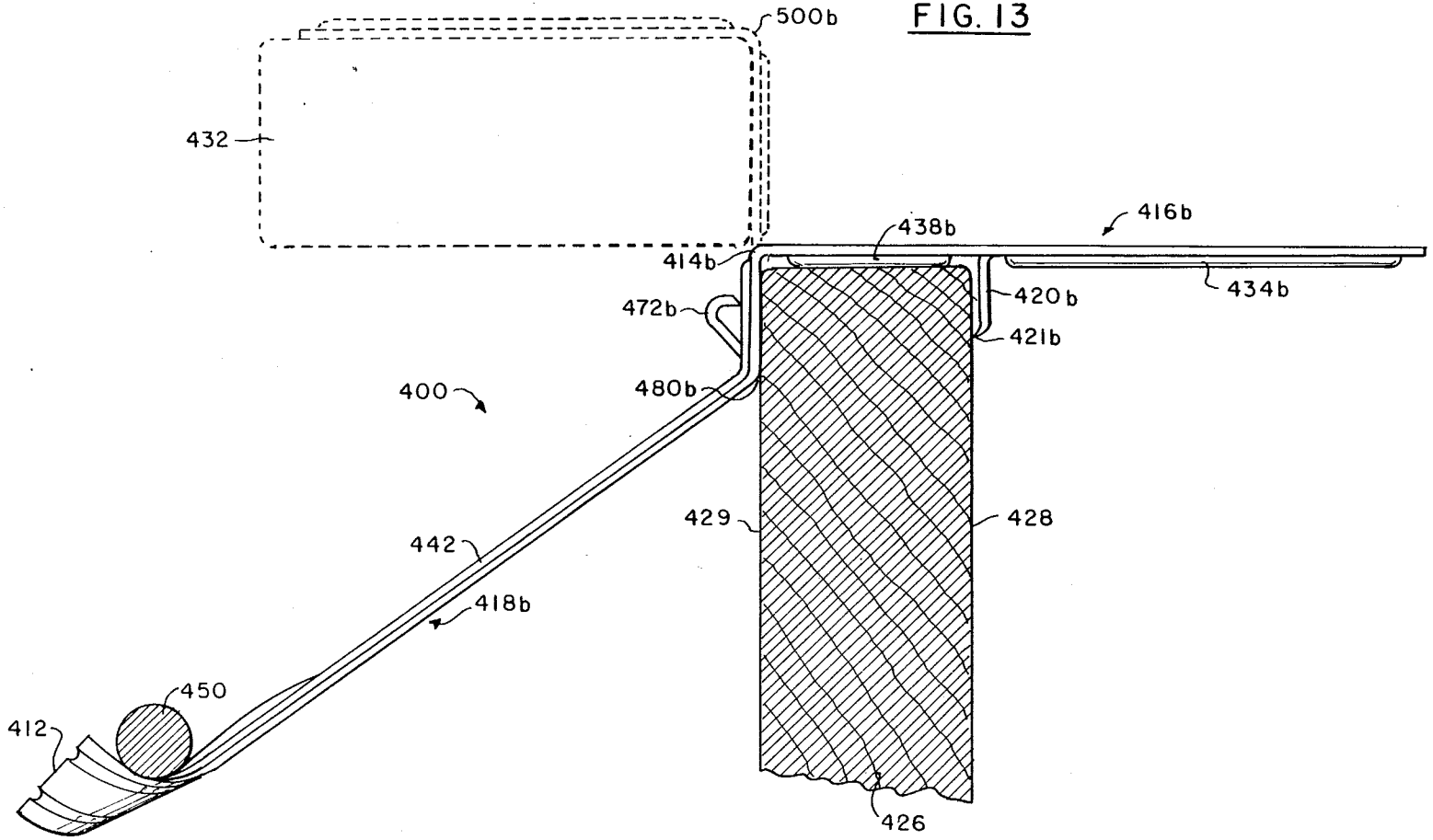
FIG. 13 is a side elevational view of the mudsill anchor of FIG. 12 as from the blank shown in FIG. 11.

By twisting the two legs or straight sections "A" and "B" in opposite directions so that their flat surfaces are in the same plane, bend section 412 will define a partial, generally frusto-conical section (as shown in FIGS. 12 and 13), that is, curved upwardly to receive a reinforcing bar as shown in FIG. 13, without the necessity of shearing or further deforming the strip of metal.

The remaining portions of each leg or generally straight end sections "A" and "B" are symmetrically sheared and deformed to define first and second leg members 418*a* and 418*b*, respectively, first and second attachment arm members 416*a* and 416*b*, respectively, and first and second gripper members or form board bearing or pressure plates 470*a* and 470*b*, respectively.

First leg member 418*a* is defined between bend section 412 and bend line 480*a* while second leg member 418*b* is defined between bend section 412 and bend line 480*b*.

First extension arm 416*a* is define between the outer end of section "A" to bend line 414*a*, while second extension arm 416*b* is define by the outer end of section "B" to bend line 414*b*.

First gripper member or form board bearing or pressure plate 470*a* is defined between bend lines 414*a* and 480*a* while second gripper member or form board bearing or pressure plate is defined between bend lines 414*b* and 480*b*.

A set of stiffening deformations 434*a*, 434*b*, 436*a*, 436*b*, 438*a*, 438*b*, 440*a*, 440*b*, 442 and 444 are provided to limit the flexing of the leg and extension arms of mudsill anchor 400.

Nail holes 446*a*, 448*a*, 450*a* and 446*b*, 448*b*, 450*b* are also provided in attachments arms 416*a* and 416*b*, respectively, to receive the nails used to attach attachment arms 416*a* and 416*b* to mudsill 432.

Mudsill anchor blank 410 further comprises a pair of form board attachment tabs 420*a* and 420*b* defined by shear lines 424*a* and 424*b* within attachment arms 416*a* and 416*b*, respectively.

Mudsill anchor blank 410 is further provided with form board nailable tabs 472*a* and 472*b* defined by shear lines 474*a* and 474*b*.

With reference to FIGS. 12 and 13 there is illustrated a plan view and side elevational view, respectively, of mudsill anchor 400 fabricated from blank 410 shown in FIG. 11 in which extension arms 416*a* and 416*b* have been bent at a 90 degree or right angle along bend lines 414*a* and 414*b*, respectively, and leg members 418*a* and 418*b* have been bent approximately 135 degrees along bend lines 480*a* and 480 to form an obtuse angle with form board bearing or pressure plate 470.

Attachment arm tabs 420*a* and 420*b* have also been bent at a right angle to the plane of the respective attachment arm to allow tips 421*a* and 421*b* to engage side 428 of form board 126.

Form board nailable tabs 472*a* and 472*b* are shown in their deformed position ready to be driven into side 429 of form board 426.

In FIG. 13, a reinforcing rod 450 is shown cradled in the deformed or bent section 412 of mudsill anchor 400 where it can be tied in place as by wire or the like.

Also shown in phantom lines is the location of mudsill 432 and the manner in which attachment arms 416*a* and 416*b* are wrapped around mudsill 432 to hold it in place after concrete has been poured level with the top of form board 426.

Figure 14:
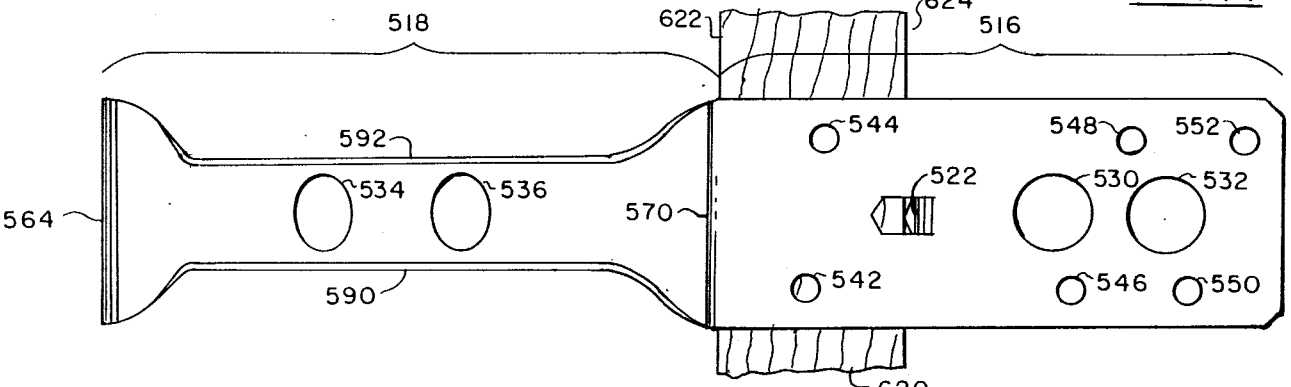
FIG. 14 is a plan view of a mudsill anchor of the completed mudsill anchor of the present invention similar to the anchor of FIG. 1 but utilizing a single mudsill attachment tab.
Figure 15:
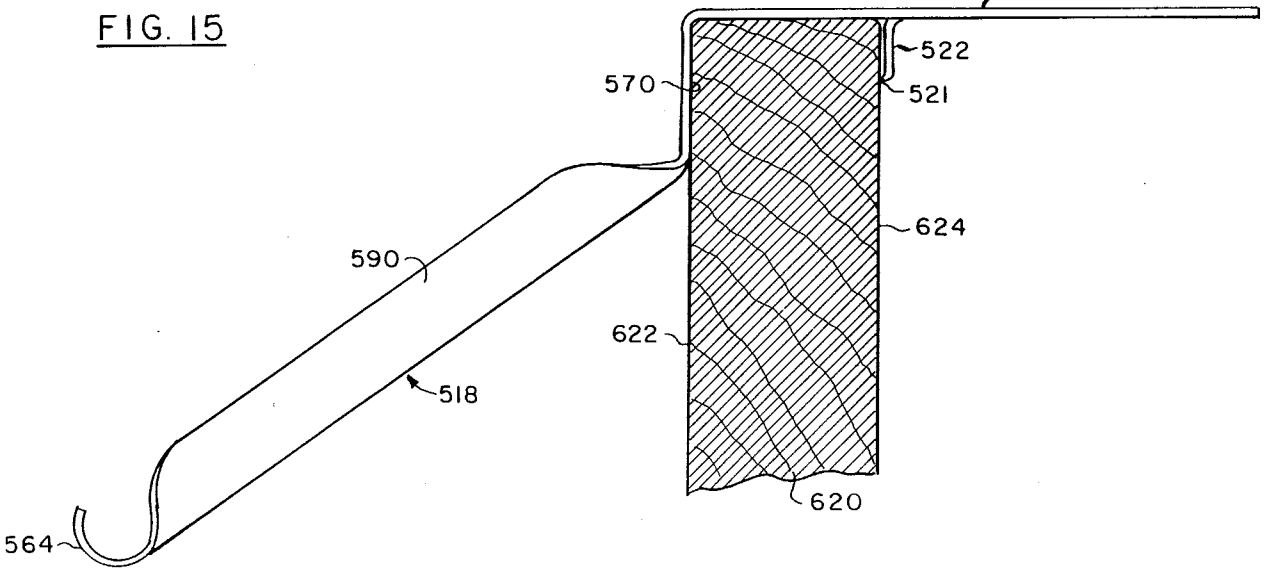
FIG. 15 is a side elevational view of the mudsill anchor of FIG. 14 shown attached to a typical form board prior to pouring concrete.

With reference to FIGS. 14 and 15, there is illustrated a further embodiment of the present mudsill anchor in which a single tab is used to attached the mudsill anchor to the form board.

The mudsill anchor 510 of FIG. 14 comprises, basically, a single attachment arm 516 comprising a single tab 520 approximately midway between the side edges of attachment arm 516 and located a distance from gripper member or pressure plate 570 approximately equal to the thickness of form board 522 defined by dotted line 524.

Nail holes 542, 544, 546, 548 and 550 are provided in extension arm 516 which are adapted to receive the nails used to attach attachment arm 16 to the mudsill (not shown in FIG. 14)

Additional holes 538 and 540 are provided in extension arm 516 to reduce the weight of mudsill anchor 510.

Mudsill anchor 510 further comprises an anchor leg 518 comprising side members 590 and 592 and reinforcing bar support member 564. Additional holes 534 and 536 are also provided in anchor leg 518 to further reduce the weight of the anchor.

Figure 5:
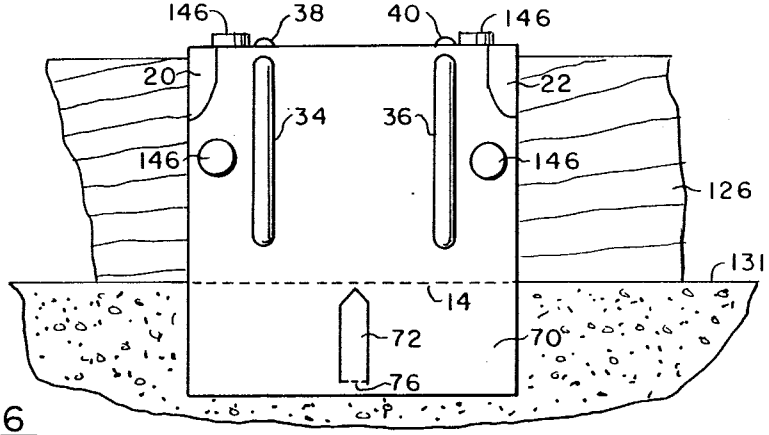
FIG. 5 is a front elevational view of the mudsill anchor of FIG. 4.
Figure 6:
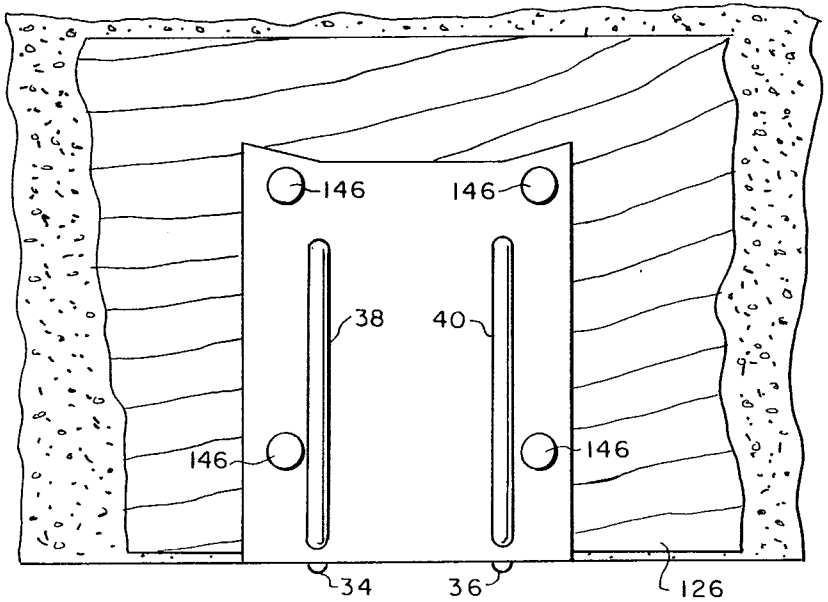
FIG. 6 is a top view of the mudsill anchor of FIGS. 4 and 5.

For the mudsill anchor shown in FIGS. 14 and 5, it can be seen that gripper or pressure plate 517 in conjuction with tab 520 will prevent lateral forces from causing anchor 510 skewing or twisting on form board 522.

Although the mudsill anchor of the present invention has been described in detail, the above description is not intended to limit the scope of this invention except as stated in the claims.

We claim:

1. In a concrete slab having a generally flat top surface and a perimeter, a form board member having an inner face temporarily placed in contact with a portion of said perimeter and an upper edge positioned parallel to the top surface of said concrete slab, a wood mudsill having a top face and an edge positioned on said concrete slab perimeter when said concrete hardens, the improvement comprising a mudsill anchor comprising a leg having a distal end embedded at an angle to the top surface of said slab and positioned downwardly from the slab perimeter and having the upper end positioned adjacent the intersection of said inner face and upper edge of said form board and bearing against the inner surface of said form board, a mudsill attachment arm having a length selected to span said mudsill edge and a substantial portion of said mudsill top face when bent over said mudsill, means for fastening said mudsill attachment arm to said mudsill, a tab depending downwardly proximate each side of said attachment arm proximate the outer face of said form board when said attachment arm is placed on the upper edge of said form board and said upper end of said anchor leg is adjacent the intersection of said inner face and upper edge of said form board.

2. The mudsill anchor as claimed in claim 1 wherein said tab further comprises a tip deformed to frictionally engage the outer face of said form board with sufficient force to hold said mudsill anchor in place during construction of said concrete slab.

3. A mudsill anchor comprising a wood mudsill, a form board having an inner surface, an outer surface and an upper edge, a mudsill anchor extension arm having a distal end and a proximal end and having a length selected for said proximal end to span one side and top of said mudsill, a mudsill anchor leg having a distal end and a proximal end, said proximal end of said anchor leg attached to said distal end of said attachment arm with said anchor leg depending downwardly at an angle to said attachment arm, means for attaching said attachment arm to said form board comprising a tab depending downwardly proximate each side of said attachment arm proximate the outer face of said form board when said attachment arm is placed on the upper edge of said form board and said proximal end of said anchor leg is adjacent the intersection of said inner face and upper edge of said form board, each of said tabs comprising a tip deformed to frictionally engage the outer face of said form board, and means proximate the point of connection of said attachment arm to said anchor leg for frictionally engaging the inner surface of said form board to maintain said tabs in frictional engagement with said outer surface of said form board.

4. A mudsill anchor for attaching a mudsill to a concrete slab poured within a peripheral form board comprising a single, generally rectangular shape piece of sheet metal deformed to define a single extension arm having a distal end coincident with one end of said piece of sheet metal, and a proximal end proximate the midpoint of said piece of sheet metal, said proximal end deformed to define a right angle to the plane of said piece of sheet metal, the length of said extension arm adapted to span one side and a portion of the top of said mudsill, an anchor leg having a distal end coincident with the other end of said piece of sheet metal and a proximal end proximate said right angle bend, said anchor leg deformed to define an obtuse angle bend a distance below said right angle bend sufficient to provide a bearing surface against the inner face said form board, means for attaching said attachment arm to said form board comprising a tab depending downwardly proximate each side of said attachment arm proximate the outer face of said form board when said right angle bend is bearing against top edge and inner surface of said form board.

5. The mudsill anchor as claimed in claim 4 wherein each of said tabs comprises a tip deformed to frictionally engage the outer surface of said form board.

6. The mudsill anchor as claimed in claim 3 further comprising a tab formed from said generally rectangular shape piece of sheet metal proximate the distal end of said anchor leg adapted to engage and attach said anchor leg to a reinforcing bar.

7. The mudsill anchor as claimed in claim 3 further comprising a prong deformed out of said sheet metal spaced apart from and proximate the side of said right angle bend adjacent the inner surface of said form board, one end of said prong remaining attached to said sheet metal, the other end of said prong shaped to a point and bent to point toward the outer surface of said form board and adapted to bear against said outer surface of said form board by force applied to said prong by pressure against side right angle bend bearing against the inside surface of said form board.

8. In a single sided mudsill anchor adapted to be embedded in a concrete slab foundation having a generally horizontal surface, a nailable form board having a top surface and edge temporarily placed in contact with a portion of the perimeter and upper edge portion parallel to the top surface of said concrete slab, said anchor formed from a single piece of sheet metal and includes an embedded leg having a distal end embedded at an angle to the top surface of said slab and having an upper end positioned adjacent the intersection of said inner face and upper edge of said form board, said anchor includes first and second laterally spaced parallel mudsill attachment arms integrally connected to said upper end of said leg and each having a portion dimensioned temporarily resting on said upper edge of said form board and extending outwardly from said form board and said slab perimeter wherein the planes of said arms are temporarily on generally the same plane and generally parallel to said top surface of said slab the improvement comprising a tab depending downwardly from each of said laterally spaced attachment arms proximate the outer face of said form board when said upper end of said anchor leg is adjacent the intersection of said inner face and upper edge of said form board.

9. The mudsill anchor as claimed in claim 8 wherein said tab comprises a tip deformed to frictionally engage the outer face of said form board with sufficient force to hold said mudsill anchor in place during construction of said concrete slab.

10. A mudsill anchor for temporary attachment to a form board comprising an elongated strip of sheet metal bent proximate its midpoint to bring the straight portions parallel to each other to define a middle bend section and a pair of first and second straight sections, said first and second straight sections twisted in opposite directions so that their flat surfaces are in the same plane and the bend section defines a partial, generally frusto-conical section, a pair of first and second attachments arms defined by bending the outer ends of each of said first and second straight sections at a right angle, a first anchor leg having a distal end continued from said middle bend section and a proximal end proximate said right angle bend, said first anchor leg deformed to define an obtuse angle bend a distance below said right angle bend sufficient to provide a bearing surface against the inner face of a form board, a second anchor leg having a distal end formed from said middle bend section and a proximal end proximate said right angle bend, said second anchor leg deformed to define an obtuse angle bend a distance below said right angle bend sufficient to provide a bearing surface against the inner face of a form board, means for attaching said first and second attachment arms to said form board comprising a first tab depending downwardly from said first attachment arm proximate the outer face of said form board when said right angle bend is bearing against the top edge and inner surface of said form board, a second tab depending downwardly from said second attachment arm proximate the outer face of said form board when said right angle bend is bearing against the top edge and inner surface of said form board.

11. The mudsill anchor as claimed in claim 10 wherein said first and second tabs each further comprise a tip deformed to frictionally engage the outer surface of said form board.

12. A method of fabricating a mudsill anchor for temporary attachment to a form board comprising the steps of bending an elongated strip of sheet metal proximate the midsection thereof to define a bent section and first and second straight portions and to bring said first and second straight end portions generally parallel to each other, twisting each of said first and second generally straight end portions in opposite directions so that their flat surfaces are in the same plane and said bent section defines a partial, generally frusto-conical section, bending each of said first and second generally straight portions at right angles to define a pair of first and second attachment arms proximate the outer ends of said first and second generally straight portions distal said bent section, bending each of said first and second generally straight portions at an obtuse angle a distance from said right angle bend to define first and second leg members and first and second form board bearing members, said first and second leg members having one end defined by said bent section and the other end defined by said obtuse angle, said first and second form board bearing members defined between said obtuse angle bend and said right angle bend between said first and second leg members and said first and second attachment arms, shearing each of said attachment arms to define a means for temporarily attaching said attachment arms to said form board.

13. The method of fabricating a mudsill anchor as claimed in claim 12 wherein said step of deforming each of said attachment arms to define a means for temporarily attaching said attachment arms to said form board comprises shearing each of said attachment arms to define a tab spaced apart from said right angle bend defining one end of said attachment arm, and bending said tab in each of said attachment arms at right angles thereto to engage the outer surface of said form board when said form board bearing surface engages the inner surface of said form board.

14. In a concrete slab having a generally flat top surface and a perimeter, a form board member having an inner face temporarily placed in contact with a portion of said perimeter and an upper edge positioned parallel to the top surface of said concrete slab, a wood mudsill having a top face and an edge positioned on said concrete slab perimeter when said concrete hardens, the improvement comprising a mudsill anchor comprising a leg having a distal end embedded at an angle to the top surface of said slab and positioned downwardly from the slab perimeter and having the upper end positioned adjacent the intersection of said inner face and upper edge of said form board, and bearing against the inner surface of said form board, a mudsill attachment arm having a length selected to span said mudsill edge and a substantial portion of said mudsill top face when bent over said mudsill, means for fastening said mudsill attachment arm to said mudsill, a tab depending downwardly approximately midway between the two side edges of said attachment arm proximate the outer face of said form board when said attachment arm is placed on the upper edge of said form board and said upper end of said anchor leg is adjacent the intersection of said inner face and upper edge of said form board.

15. A mudsill anchor comprising a wood mudsill, a form board having an inner surface, an outer surface and an upper edge, a mudsill anchor extension arm having a distal end and a proximal end and having a length selected for said proximal end to span one side and top of said mudsill, a mudsill anchor leg having a distal end and a proximal end, said proximal end of said anchor leg attached to said distal end of said attachment arm with said anchor leg depending downwardly at an angle to said attachment arm, means for attaching said attachment arm to said form board comprising a tab depending downwardly approximately midway between the side edges of said attachment arm proximate the outer face of said form board when said attachment arm is placed on the upper edge of said form board and said proximal end of said anchor leg is adjacent the intersection of said inner face and upper edge of said form board, each of said tabs comprising a tip deformed to frictionally engage the outer face of said form board, and means proximate the point of connection of said attachment arm to said anchor leg for frictionally engaging the inner surface of said form board to maintain said tabs in frictional engagement with said outer surface of said form board.

16. A mudsill anchor for attaching a mudsill to a concrete slab poured within a peripheral form board comprising a single, generally rectangular shape piece of sheet metal deformed to define a single extension arm having a distal end coincident with one end of said piece of sheet metal, and a proximal end proximate the midpoint of said piece of sheet metal, said proximal end deformed to define a right angle to the plane of said piece of sheet metal, the length of said extension arm adapted to span one side and a portion of the top of said mudsill, an anchor leg having a distal end coincident with the other end of said piece of sheet metal and a proximal end proximate said right angle bend, said anchor leg deformed to define an obtuse angle bend a distance below said right angle bend sufficient to provide a bearing surface against the inner face said form board, means for attaching said attachment arm to said form board comprising a tab depending downwardly approximately midway between the side edges of said attachment arm proximate the outer face of said form board when said right angle bend is bearing against top edge and inner surface of said form board.

* * * * *